US007159864B1

(12) United States Patent
Fleury

(10) Patent No.: US 7,159,864 B1
(45) Date of Patent: Jan. 9, 2007

(54) GOLF GAME APPARATUS

(76) Inventor: Christian Fleury, 755 Le Cavalier #2, St. Majorique, QC (CA) J2B 8A8

( * ) Notice: Subject to any disclaimer, the term of this patent is extended or adjusted under 35 U.S.C. 154(b) by 0 days.

(21) Appl. No.: 11/214,118

(22) Filed: Aug. 30, 2005

(51) Int. Cl.
*A63B 67/00* (2006.01)

(52) U.S. Cl. ..... 273/108.2; 473/233; 473/288; 473/150; 473/157

(58) Field of Classification Search ..... 473/219, 473/226, 231–233, 238, 287, 288, 131, 150, 473/157; 273/108, 108.1, 108.2
See application file for complete search history.

(56) References Cited

U.S. PATENT DOCUMENTS 4,270,753 A * 6/1981 Maroth et al. ..... 473/233
4,363,488 A * 12/1982 Maroth et al. ..... 473/233
6,231,453 B1 * 5/2001 Jebe ..... 473/233
6,705,952 B1 * 3/2004 Vecsey ..... 473/232
7,059,600 B1 * 6/2006 Jarimba ..... 273/108.2

* cited by examiner

*Primary Examiner*—Raleigh W. Chiu
(74) *Attorney, Agent, or Firm*—Crossley Patent Law; Mark A. Crossley

(57) ABSTRACT

A golf game apparatus which provides a unique form of swing measurement, scaled course maps for play, and interchangeable club heads to play with. The apparatus is particularly suited to indoor play with the scaled maps. The apparatus features recordable ball distance measurement which is reset after each swing, thereby enabling a player to progress along the course map.

5 Claims, 4 Drawing Sheets

GOLF GAME APPARATUS

BACKGROUND OF THE INVENTION

Golf is a game which cannot always be enjoyed, due to inclement and seasonal weather, as well as an individual's geographic location. Various indoor golf games are provided for enjoyment and for training. The challenges faced in providing an indoor game which accurately measures swing and offers accurate swing feel are well known. Challenges are also faced in that different clubs, such as irons versus woods, do not feel the same or impact a ball the same. The present invention offers unique solutions to indoor golf.

FIELD OF THE INVENTION

The present invention relates to golf and more specifically to a golf game apparatus which provides a unique form of swing measurement, scaled course maps for play, and interchangeable club heads to play with.

SUMMARY OF THE INVENTION

The general purpose of the golf game apparatus, described subsequently in greater detail, is to provide a golf game apparatus which has many novel features that result in an improved golf game apparatus which is not anticipated, rendered obvious, suggested, or even implied by prior art, either alone or in combination thereof.

The golf game apparatus enables a user or users to play a simulated round of golf even indoors. The golf game apparatus provides player with the same outlet for competition as a traditional round of golf. The invention is particularly suited to the winter months when a round of outdoor golf is not possible. The game apparatus comprises a small shaft with a conventional grip installed on the top of the shaft. A set of interchangeable club heads provide for each club head to be selected and removably secured to the end of the shaft opposite the grip. A series of golf course maps is provided as a part of the invention. Each map includes an 18 hole course, whether fictitious or a representation of an actual course. After selecting a course and mapping a tee shot, the golfer hits the hook and loop covered lightweight golf ball from a tee. The shaft of the club features a measuring device which calculates and displays the distance and of the shot. After hitting the tee shot and checking the display, the golfer plots the next shot on the hole layout of that chosen map. The golfer changes the club head in an attempt to correctly hit the shot. The measuring device is consulted for the shot result, at which time the golfer repeats the above procedure as needed until the green is reached. Upon reaching the green, the player plays on existing carpet with the scaled green of the map.

Thus has been broadly outlined the more important features of the golf game apparatus so that the detailed description thereof that follows may be better understood and in order that the present contribution to the art may be better appreciated.

Numerous objects, features and advantages of the golf game apparatus will be readily apparent to those of ordinary skill in the art upon reading the following detailed description of presently preferred, but nonetheless illustrative, examples of the golf game apparatus when taken in conjunction with the accompanying drawings. In this respect, before explaining the current examples of the golf game apparatus in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the golf game apparatus. It is therefore important that the claims be regarded as including such equivalent constructions insofar as they do not depart from the spirit and scope of the present invention.

Objects of the golf game apparatus, along with various novel features that characterize the invention are particularly pointed out in the claims forming a part of this disclosure. For better understanding of the golf game apparatus, its operating advantages and specific objects attained by its uses, refer to the accompanying drawings and description.

DETAILED DESCRIPTION OF THE DRAWINGS

With reference now to the drawings, and in particular FIGS. 1 through 4 thereof, example of the golf game apparatus employing the principles and concepts of the present invention and generally designated by the reference number 10 will be described.

Figure 1:
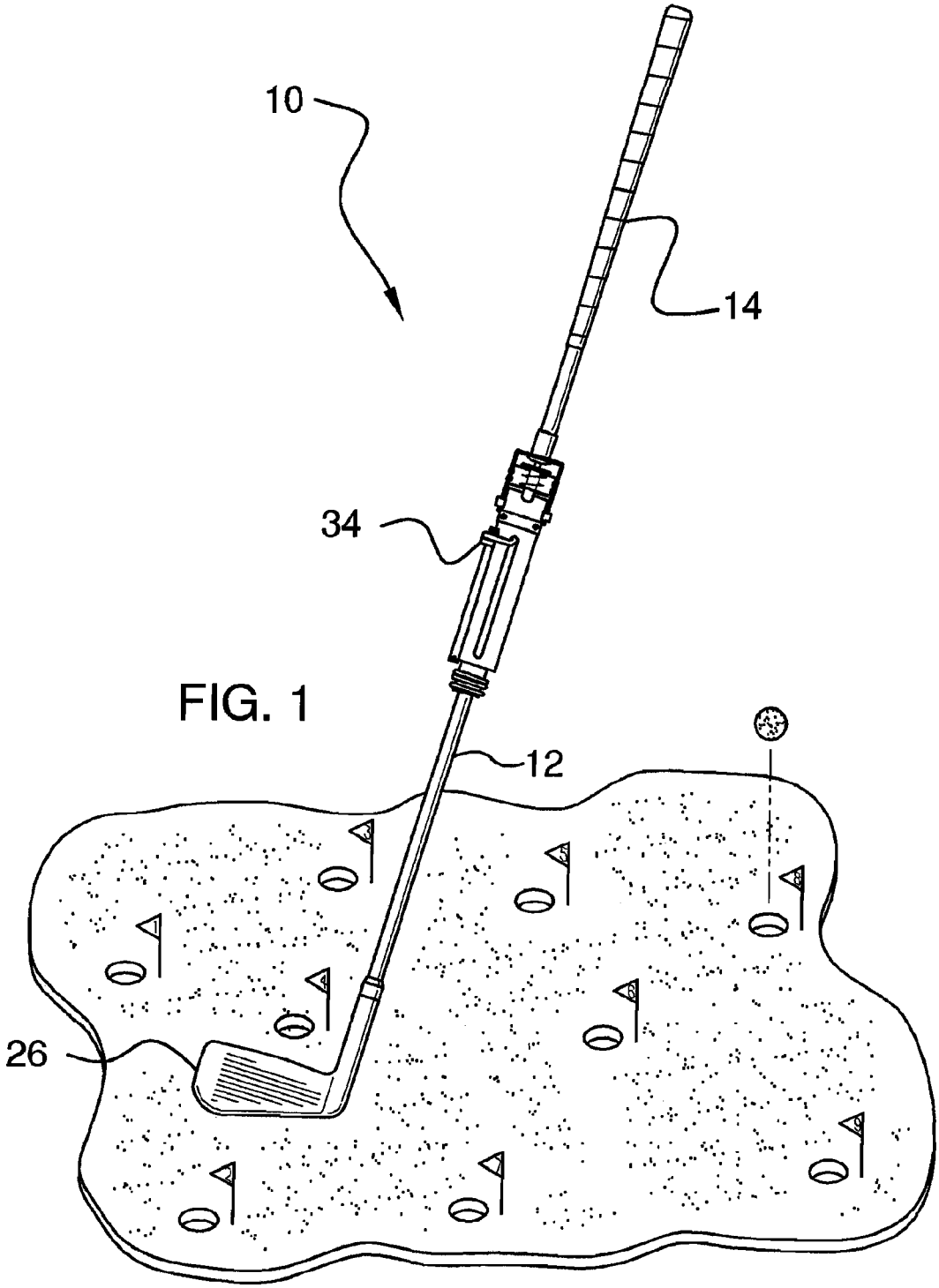
FIG. 1 is an elevation of the invention with the iron head installed.

Referring to FIG. 1, the invention 10 comprises a plurality of scaled golf course maps (not shown). The maps have a textured surface to which the lightweight, hook and loop covered ball (not shown) removably adheres. The invention 10 further comprises a club shaft 12 having two opposite ends, an upper end and a lower end, and a length therebetween. A grip 14 is disposed on the upper end of the shaft 12. An iron 26 represents one of a plurality of club heads 16 that are removably affixed to the lower end of the shaft 12. The measurement device along the length of the shaft 12 registers the distance of a golf swing via centrifugal force generated by swinging the club of the invention 10.

Figure 2:
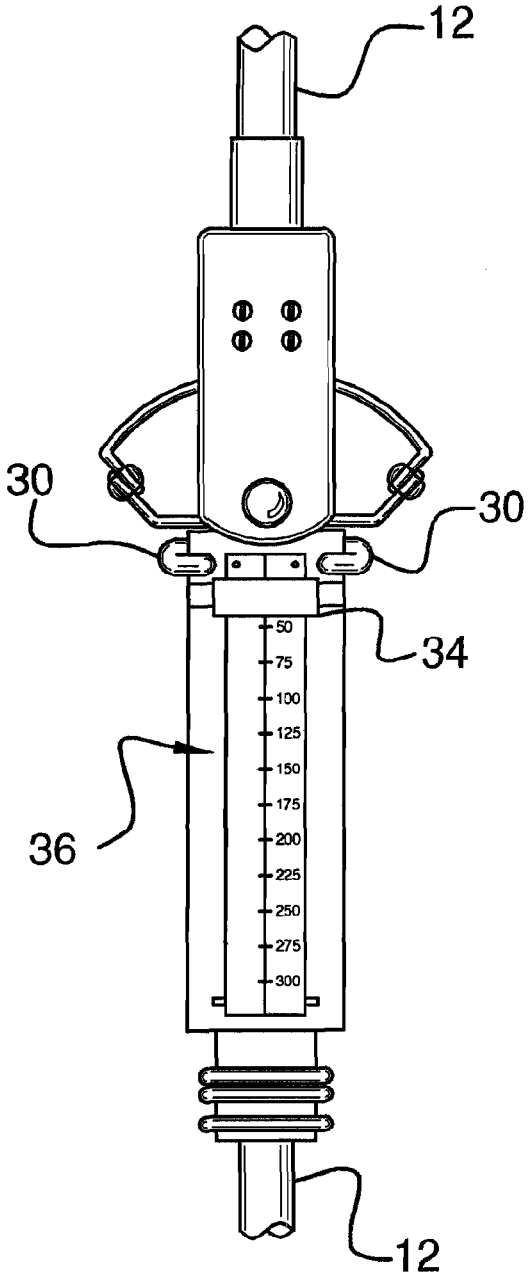
FIG. 2 is an elevation of the measurement device of the invention, illustrating the measurement bar which moves along the yardage scale.
Figure 3:
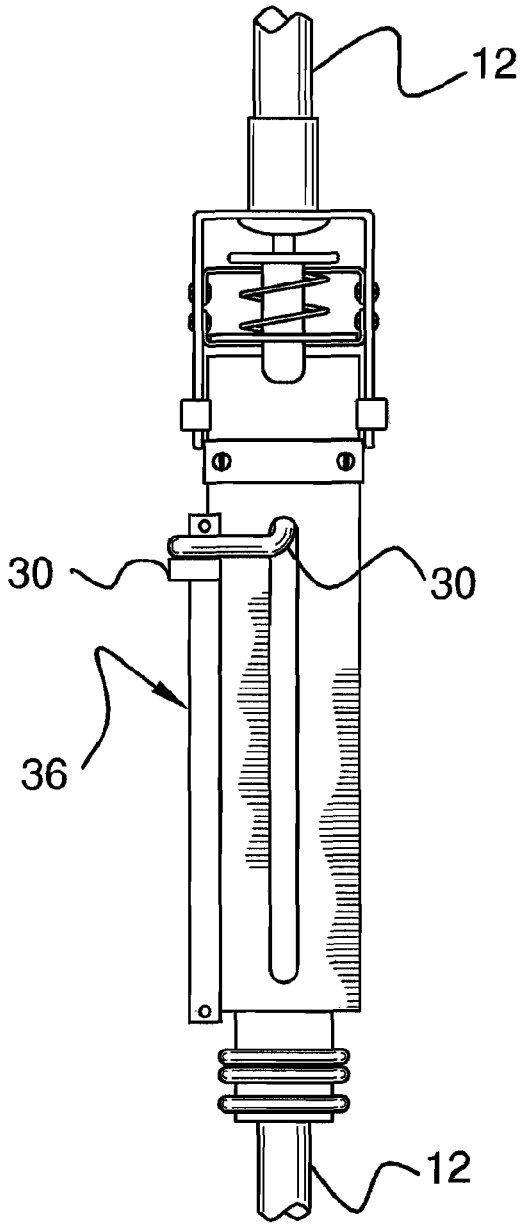
FIG. 3 is an elevation of the measurement device of FIG. 2, the device rotated 90 degrees in the vertical plane.
Figure 4:
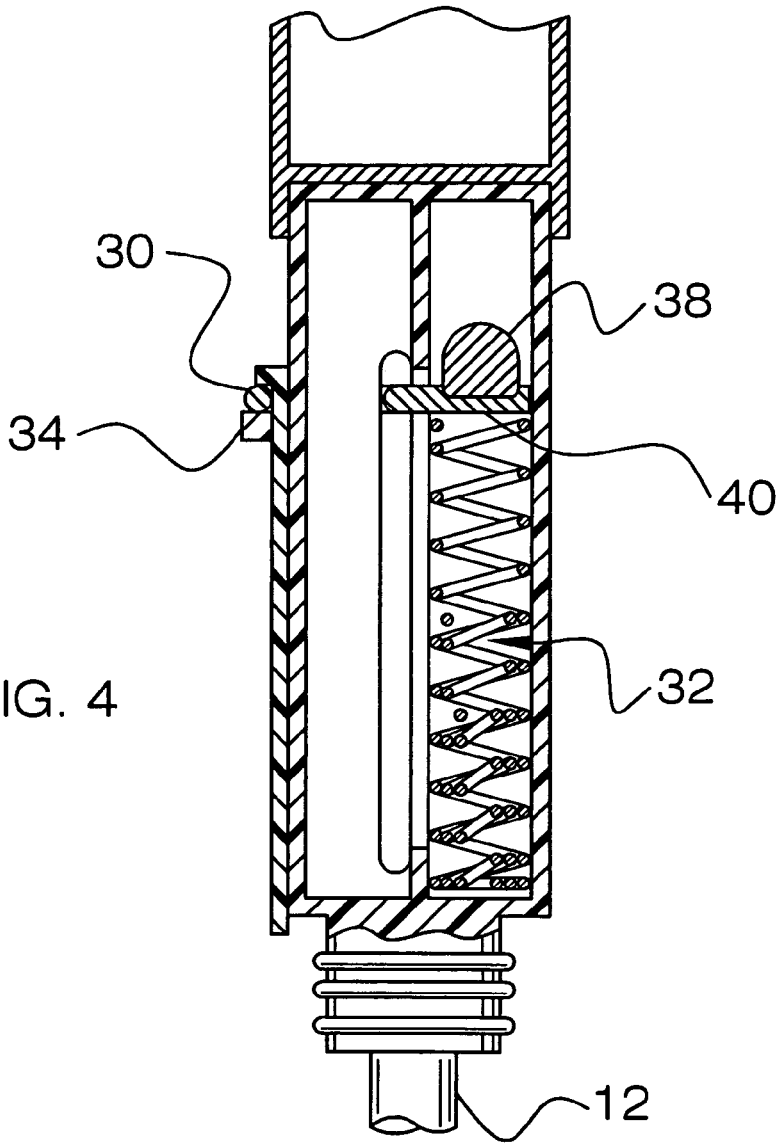
FIG. 4 is a cross sectional view of the measurement device of FIG. 3.

Referring to FIGS. 2, 3, and 4, the measurement device further comprises a movably positioned measurement bar 34. The bar 34 is frictionally positionable along the yardage scale 36 of the measurement device fitted to the club shaft 12. The measurement bar 34 is displaced along the yardage scale 36 by a pair of movement arms 30. The movement arms 30 are connected to a compression block 40. The slideably movable weight 38 is disposed within the measurement device. The weight 38 is disposed above the slideably movable compression block 40. The compression block 40 is movably held upward by three compression springs 32, each of progressive compression characteristics. The compression springs 32 resist downward movement of the compression block 40. The plurality of springs 32 is provided in order to accurately gauge the centrifugal force of the club swing. The measurement bar 34 is pushed downwardly by the movement arms 30. The measurement bar 34 is temporarily and frictionally held in position proximal to the yardage scale 36. The deflection of the movement arms 30 is thereby recorded on the yardage scale 36 by the measurement bar 34. After a swing, the yardage scale 36 provides for accurate placement of the ball along one of the maps provided, thereby progressing the player along a given hole of the course map. The measurement bar 34 is slid back to zero on the yardage scale 36 and the next swing taken. The player thusly progresses.

Figure 5:
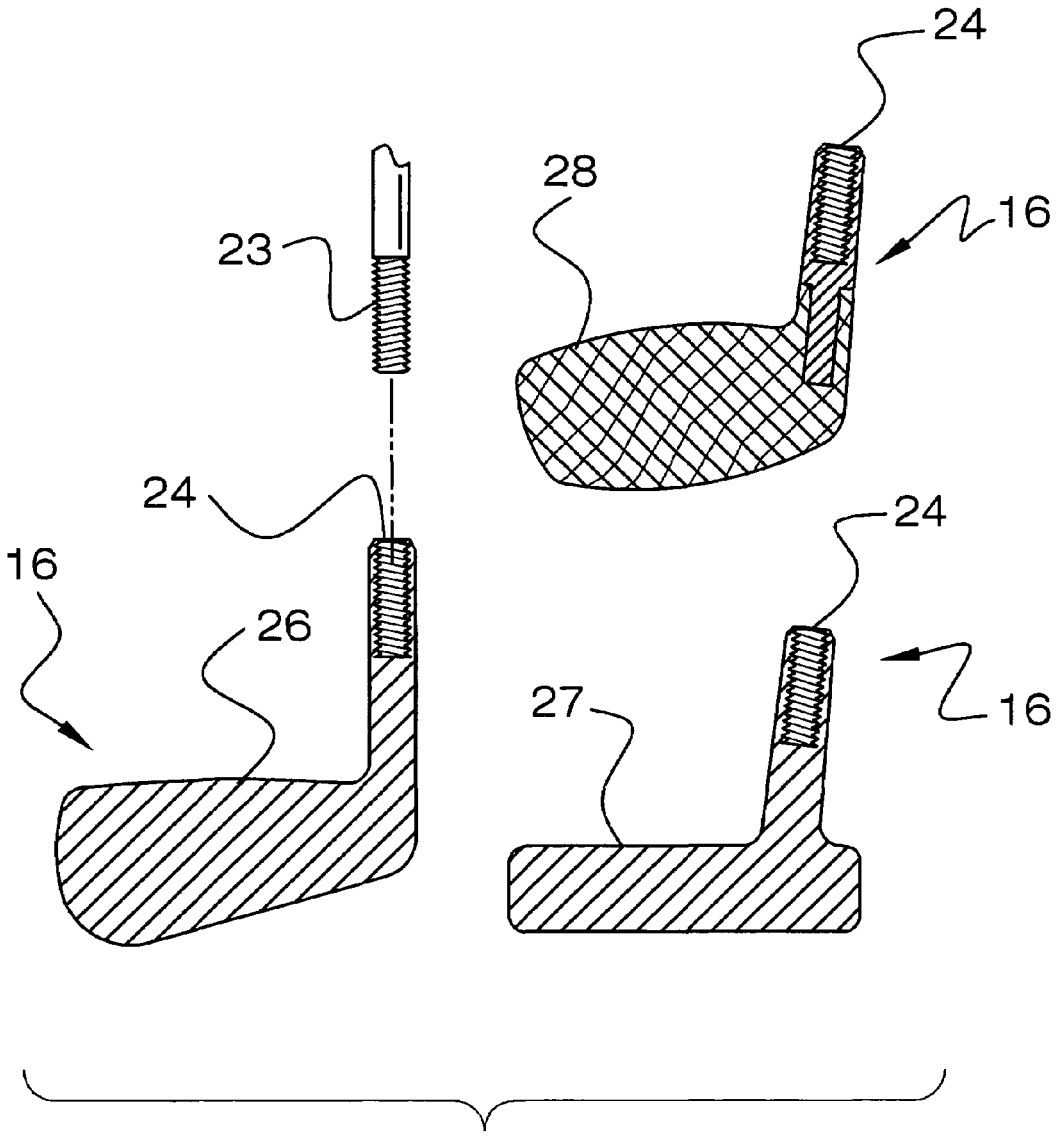
FIG. 5 is an elevation of the club heads and their attachment to the shaft.

Referring to FIG. 5, a male thread 23 is disposed on the lower end of the shaft 12. A plurality of club heads 16 are provided for removable attachment to the male thread 23 of lower end of the shaft 12. The club heads include a wood 28, a plurality of irons 26, and at least one putter 27. Each club head 16 comprises a female thread 24 for threadable attachment to the shaft 12.

With respect to the above description then, it is to be realized that the optimum dimensional relationships for the parts of the golf game apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A golf game apparatus comprising:

a plurality of scaled golf course maps, the maps having a textured surface;

a club shaft having two opposite ends, an upper end and a lower end, and a length therebetween;

a grip on the upper end of the shaft;

a male thread on the lower end of the shaft;

a plurality of female threaded club heads for removable attachment to the male threaded shaft end;

a lightweight hook and loop covered golf ball, the ball removably positionable on the maps;

a measurement device along the length of the shaft, the measurement device registering the distance of a golf swing via centrifugal force generated by swinging the club.

2. The invention in claim 1 wherein the club heads are selected from the group consisting of woods, irons, and putters.

3. The invention in claim 2 wherein the measurement device further comprises a movably positioned measurement bar, the bar frictionally positionable along a yardage scale of the measurement device.

4. The invention in claim 3 wherein the measurement bar is displaced along the yardage scale by a pair of movement arms;

the movement arms connected to a compression block;

a slideably movable weight disposed within the measurement device, the weight disposed above a compression block, the compression block movably disposed below the weight.

5. The invention in claim 1 wherein the measurement device further comprises a movably positioned measurement bar, the bar frictionally positionable along a yardage scale of the measurement device.

* * * * *